US008289008B2

(12) United States Patent
Chang et al.

(10) Patent No.: US 8,289,008 B2
(45) Date of Patent: Oct. 16, 2012

(54) VOLTAGE REGULATOR WHICH PROVIDES SEQUENTIALLY AND ARBITRARRILY SHAPED REGULATED VOLTAGE AND RELATED METHOD

(75) Inventors: Jui-Yu Chang, Taoyuan County (TW); Chih-Wei Chen, Taipei (TW); Jin-Lien Lin, Taoyuan County (TW)

(73) Assignee: RichWave Technology Corp., NeiHu District, Taipei (TW)

( * ) Notice: Subject to any disclaimer, the term of this patent is extended or adjusted under 35 U.S.C. 154(b) by 364 days.

(21) Appl. No.: 12/726,340

(22) Filed: Mar. 17, 2010

(65) Prior Publication Data

US 2011/0156667 A1 Jun. 30, 2011

(30) Foreign Application Priority Data

Dec. 24, 2009 (TW) ..... 98144714 A

(51) Int. Cl.
*G05F 1/40* (2006.01)

(52) U.S. Cl. ..... 323/265; 323/280

(58) Field of Classification Search ..... 323/265, 323/273, 279, 280, 282, 283, 351
See application file for complete search history.

(56) References Cited

U.S. PATENT DOCUMENTS 4,543,522 A * 9/1985 Moreau ..... 323/303
5,179,294 A * 1/1993 Bechade et al. ..... 327/172
5,272,729 A * 12/1993 Bechade et al. ..... 375/371
5,278,456 A * 1/1994 Bechade et al. ..... 327/175
6,166,977 A * 12/2000 Saitoh et al. ..... 365/205
6,269,051 B1 * 7/2001 Funaba et al. ..... 365/233.11
6,977,492 B2 * 12/2005 Sutardja et al. ..... 323/283
7,109,692 B1 * 9/2006 Wu et al. ..... 323/282
7,423,414 B1 * 9/2008 Culpepper et al. ..... 323/280
7,492,132 B2 * 2/2009 Kuroiwa et al. ..... 323/222

FOREIGN PATENT DOCUMENTS

CN 1838020 A 9/2006
JP 3158911 7/1991

* cited by examiner

*Primary Examiner* — Adolf Berhane
(74) *Attorney, Agent, or Firm* — Winston Hsu; Scott Margo

(57) ABSTRACT

A voltage regulator includes an amplifier, a power device, a delay signal generator, and a voltage-generating circuit. The amplifier generates a control signal according to a reference voltage and a feedback voltage. The power switch generates the output voltage by regulating the output current according to the switch control signal. The delay signal generator generates a plurality of sequential delay signals each having distinct delay time with respect to an externally applied power-on burst signal. The voltage-generating circuit provides an equivalent resistance for generating the feedback voltage corresponding to the output voltage, and regulates the output voltage by adjusting the equivalent resistance according to the plurality of sequential delay signals.

14 Claims, 6 Drawing Sheets

VOLTAGE REGULATOR WHICH PROVIDES SEQUENTIALLY AND ARBITRARRILY SHAPED REGULATED VOLTAGE AND RELATED METHOD

BACKGROUND OF THE INVENTION

1. Field of the Invention

The present invention is related to a voltage regulator and related method, and more particularly, to a voltage regulator which provides sequentially and arbitrarily shaped regulated voltage and related method.

2. Description of the Prior Art

In electronic products, voltage regulators are usually disposed between a power supply circuit and a load circuit. The function of a voltage regulator is to provide a stable output voltage and a wide-ranged output current. When the load current suddenly changes, the output voltage can then be stabilized at its original level for providing efficient voltage conversion. For portable devices such as mobile phones, personal digital assistants (PDAs) and notebook computers, the voltage of the battery drops with time and is unable to maintain at a stable level. A low dropout (LDO) regulator can continuously provide a stable output voltage to the load circuit of an electronic device as long as the voltage difference between the input voltage provided by the battery and the estimated output voltage of the LDO regulator is larger than a dropout voltage.

Reference is made to FIG. 1 for a diagram illustrating a prior art LDO regulator 10. The LDO regulator 10 includes an error amplifier 110, a power device 120, a voltage-dividing circuit 130, and an output capacitor Co. The LDO regulator 10 is configured to convert an input voltage $V_{IN}$ into an output voltage $V_{OUT}$ for driving a load (represented by a resistor $R_L$) through which a current $I_L$ flows. The voltage-dividing circuit 130, including resistors $R_1$ and $R_2$, is configured to generate a feedback voltage $V_{FB}$ corresponding to the output voltage $V_{OUT}$ by voltage-dividing the output voltage $V_{OUT}$. The error amplifier 110 is configured to generate a control signal $V_{SW}$ by comparing the feedback voltage $V_{FB}$ with a reference voltage $V_{REF}$. The output capacitor Co, coupled in parallel with the load $R_L$, provides the load $R_L$ with current compensation when the load current $I_L$ suddenly changes, thereby improving the transient response of the output voltage $V_{OUT}$. The power device 120 may be a P-channel metal oxide semiconductor (PMOS) switch having a gate for receiving the control signal $V_{SW}$ from the error amplifier 110, a source for receiving the input voltage $V_{IN}$, and a drain for receiving the output voltage $V_{OUT}$. When the feedback voltage $V_{FB}$ is smaller than the reference voltage $V_{REF}$, the control signal $V_{SW}$ generated by the error amplifier 110 increases the output current of the power device 120; when the feedback voltage $V_{FB}$ is larger than the reference voltage $V_{REF}$, the control signal $V_{SW}$ generated by the error amplifier 110 decreases the output current of the power device 120. Therefore, the LDO regulator can stabilize the output voltage $V_{OUT}$ at a predetermined value $V_{OUT_NON}$. The relationship between the output voltage $V_{OUT}$ and the reference voltage $V_{REF}$ is depicted as follows:

$$V_{OUT}=(R_1+R_2)*V_{REF}/R_1$$

where $(R_1+R_2)/R_1$ has a constant value.

In a modern wireless transceiver, its receiver RX and transmitter TX operate alternatively, in which only one of the receiver RX and the transmitter TX is activated at a specific time. The transmitter TX is activated only during the transmitting bursts of communication packages, and is otherwise deactivated in order to reduce power consumption. The transmitter TX is required to provide output signal of unvarying characteristics (such as constant output power and phase) anytime during a transmitting burst. However, the circuit of the transmitter TX (such as a power amplifier) has a certain turn-on response time and a certain turn-off response time, both of which normally vary with temperature. In order to maintain unvarying signal characteristics, the time response of the transmitter needs to be compensated by, for instance, adjusting the bias voltage of the transmitter TX or the supply voltage of the receiver RX as the time elapses. In both cases, the bias voltage and the supply voltage are normally generated by the voltage regulator.

Reference is made to FIG. 2 for a diagram illustrating the operation of a prior art wireless transceiver. The waveforms depicted in FIG. 2 represent the bias voltage of the transmitter TX or the supply voltage of the receiver RX provided by the LDO regulator 10. The transmitting bursts of the transmitter TX are represented by $B_{T1}$-$B_{Tn}$, while the receiving bursts of the receiver RX are represented by $B_{R1}$-$B_{Rn}$. As previously stated, the turn-on response time and the turn-off response time of the transmitter TX and the receiver RX vary with temperature. Since the prior art LDO regulator 10 does not provide compensation, the prior art wireless transceiver may not be able to provide unvarying signal characteristics during the transmitting/receiving bursts of different communication packages.

SUMMARY OF THE INVENTION

The present invention provides a voltage regulator which provides sequentially and arbitrarily shaped regulated voltage. The voltage regulator comprises an amplifier, a power device, and a voltage-generating circuit. The amplifier is coupled to a reference voltage and a feedback voltage for generating a control signal, the amplifier comprising a first input end coupled to the reference voltage; a second input end coupled to the feedback voltage; and an output end for outputting the control signal. The power device comprises a first input end coupled to an input voltage; a second input end coupled to the output voltage; and a control end coupled to the control signal. The delay signal generator is coupled to an externally applied power-on burst signal for generating a plurality of sequential delay signals each having distinct delay time with respect to the power-on burst signal. The voltage-generating circuit is coupled to the output voltage and the plurality of sequential delay signals for generating the feedback voltage.

The present invention further provides a method for sequentially and arbitrarily regulating an output voltage. The method comprises generating a plurality of sequential delay signals according to an externally applied power-on burst signal, wherein each sequential delay signal has a distinct delay time with respect to the power-on burst signal; adjusting an equivalent resistance according to the plurality of sequential delay signals; generating a feedback voltage by voltage-dividing the output voltage according to the equivalent resistance; and regulating the output voltage according to the feedback voltage.

The present invention further provides a voltage regulator which sequentially and arbitrarily regulates an output voltage. The voltage regulator generates a plurality of sequential delay signals according to an externally applied power-on burst signal, each sequential delay signal having a distinct delay time with respect to the power-on burst signal. And the voltage regulator regulates the output voltage according to the plurality of sequential delay signals so as to maintain the output voltage at a predetermined level at a specific time.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
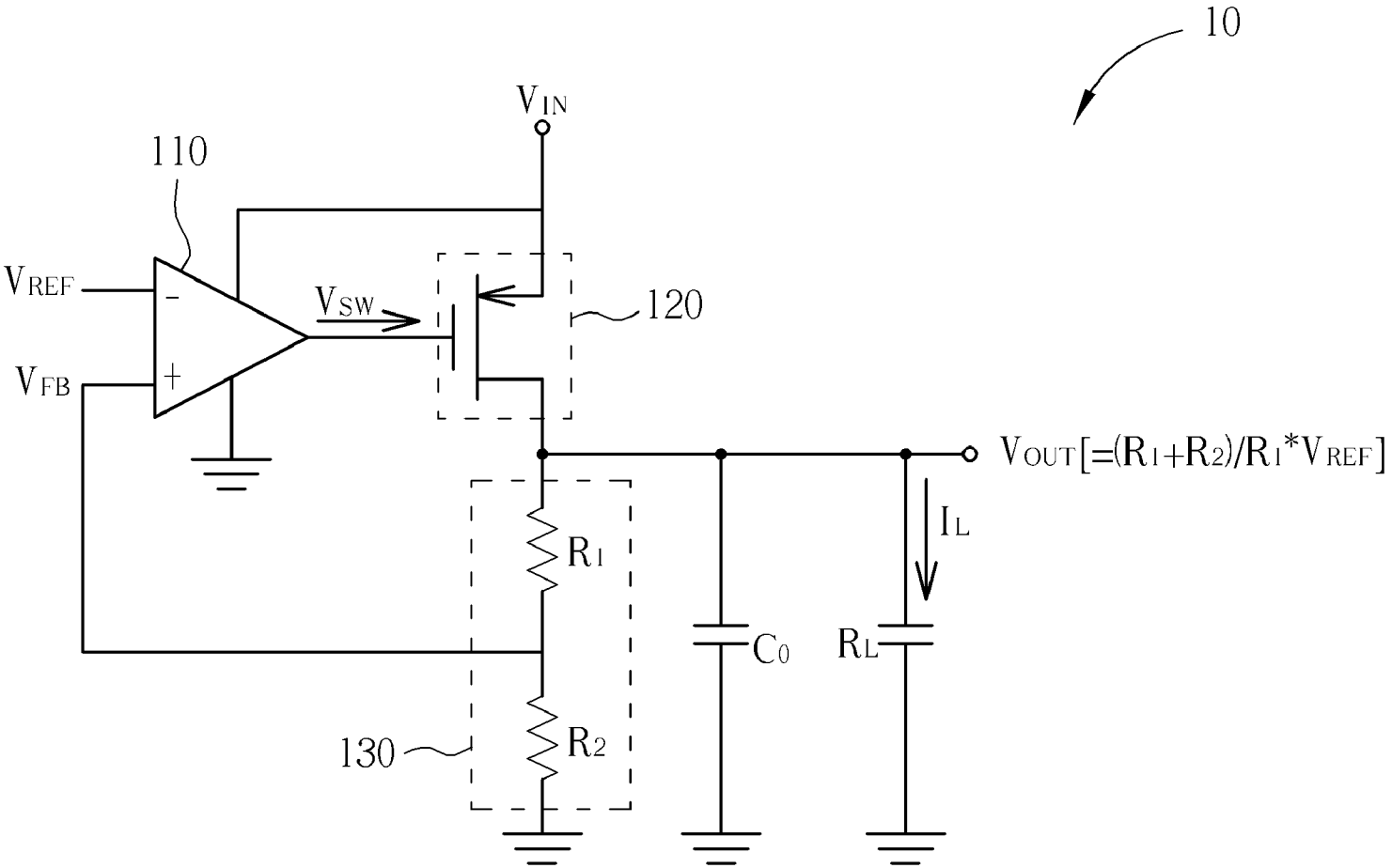
FIG. 1 PRIOR ART
FIG. 1 is a diagram illustrating a prior art LDO regulator 10.
Figure 2:
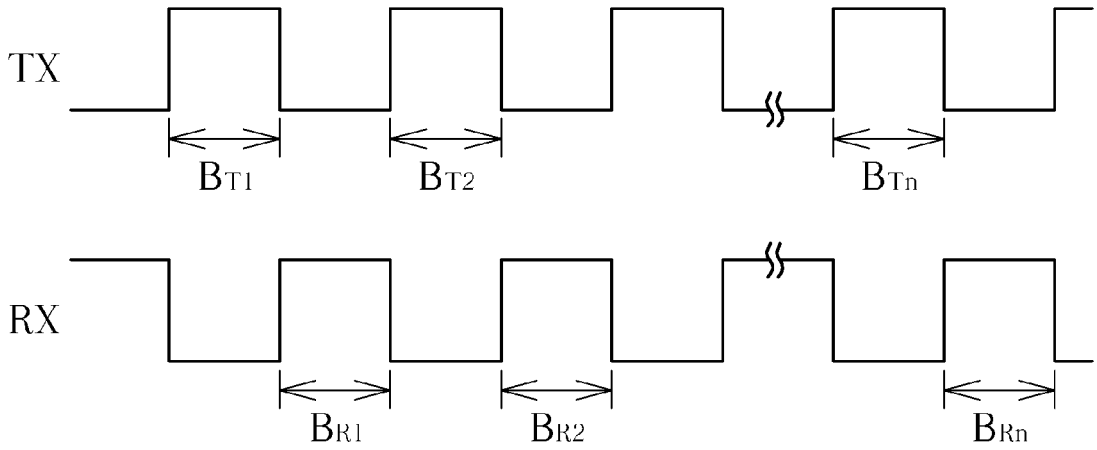
FIG. 2 PRIOR ART
FIG. 2 is a diagram illustrating the operation of a prior art wireless transceiver.
Figure 3:
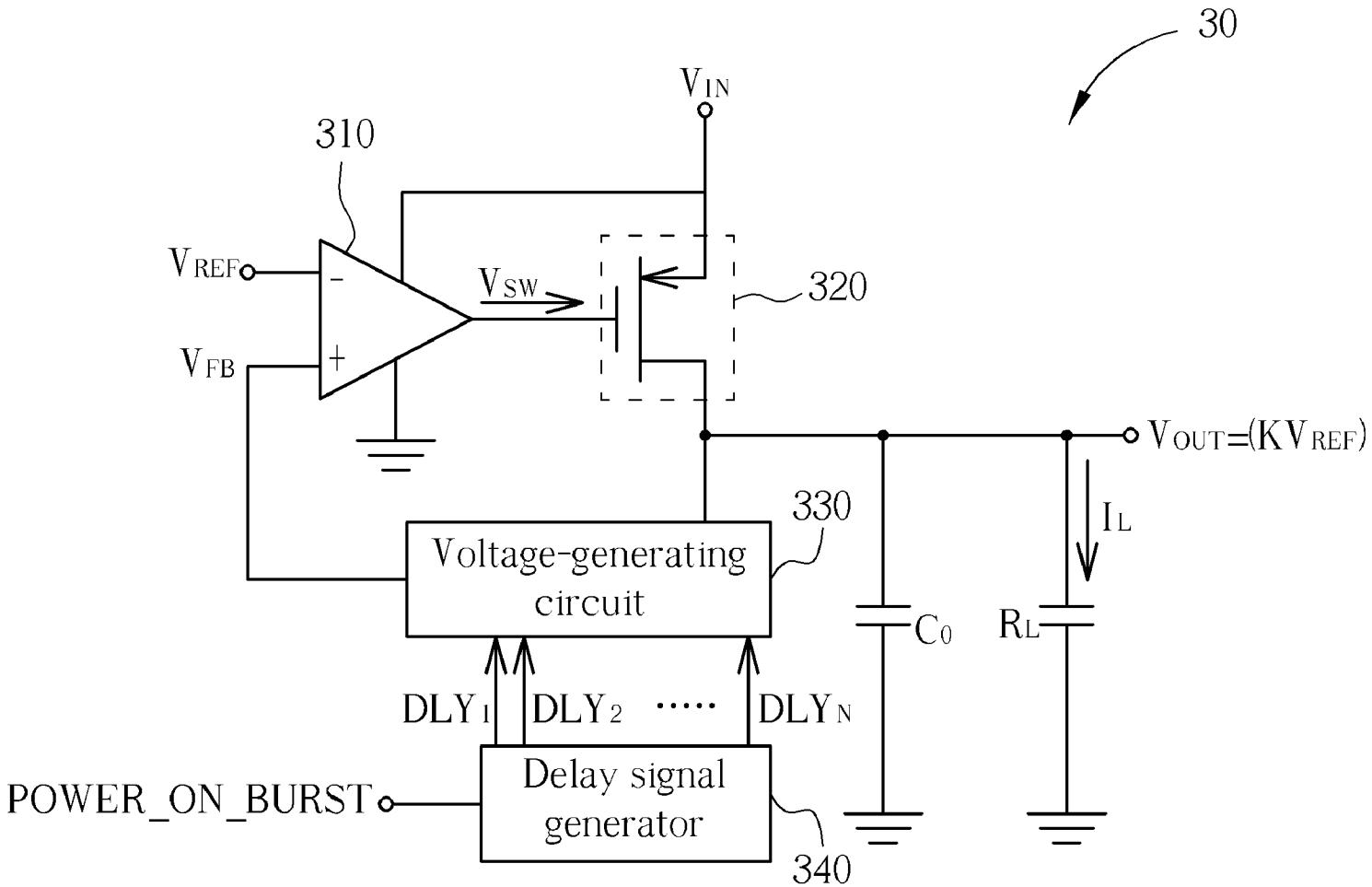
FIG. 3 is a diagram illustrating an LDO regulator according to the present invention.

Reference is made to FIG. 3 for a diagram illustrating an LDO regulator 30 according to the present invention. The LDO regulator 30 includes an error amplifier 310, a power device 320, a voltage-generating circuit 330, a delay signal generator 340, and an output capacitor Co. The LDO regulator 30 is configured to convert an input voltage $V_{IN}$ into an output voltage $V_{OUT}$ for driving a load (represented by a resistor $R_L$) through which a current $I_L$ flows. The output capacitor Co, coupled in parallel with the load $R_L$, provides the load $R_L$ with current compensation when the load current $I_L$ suddenly changes, thereby improving the transient response of the output voltage $V_{OUT}$. The voltage-generating circuit 330 is configured to generate a feedback voltage $V_{FB}$ corresponding to the output voltage $V_{OUT}$ ($V_{OUT}=K*V_{REF}$) by voltage-dividing the output voltage $V_{OUT}$. The error amplifier 310 is configured to generate a control signal $V_{SW}$ by comparing the feedback voltage $V_{FB}$ with a reference voltage $V_{REF}$. The power device 320 may be, but not limited to, a PMOS switch having a gate for receiving the control signal $V_{SW}$ from the error amplifier 310, a source for receiving the input voltage $V_{IN}$, and a drain for receiving the output voltage $V_{OUT}$. The power device 320 operates according to the control signal $V_{SW}$: when the feedback voltage $V_{FB}$ is smaller than the reference voltage $V_{REF}$, the control signal $V_{SW}$ generated by the error amplifier 310 increases the output current of the power device 320; when the feedback voltage $V_{FB}$ is larger than the reference voltage $V_{REF}$, the control signal $V_{SW}$ generated by the error amplifier 310 decreases the output current of the power device 320.

The delay signal generator 340, which operates according to an externally applied power-on burst signal POWER_ON_BURST, is configured to generate a plurality of delay signals DLY1-DLYn each having distinct delay time with respect to the power-on burst signal POWER_ON_BURST. The voltage-generating circuit 330 can adjust the predetermined value of the output voltage $V_{our}$ at different time by varying the value of K according to the delay signals DLY1-DLYn, thereby regulating the waveform of the output voltage $V_{OUT}$.

Figure 4:
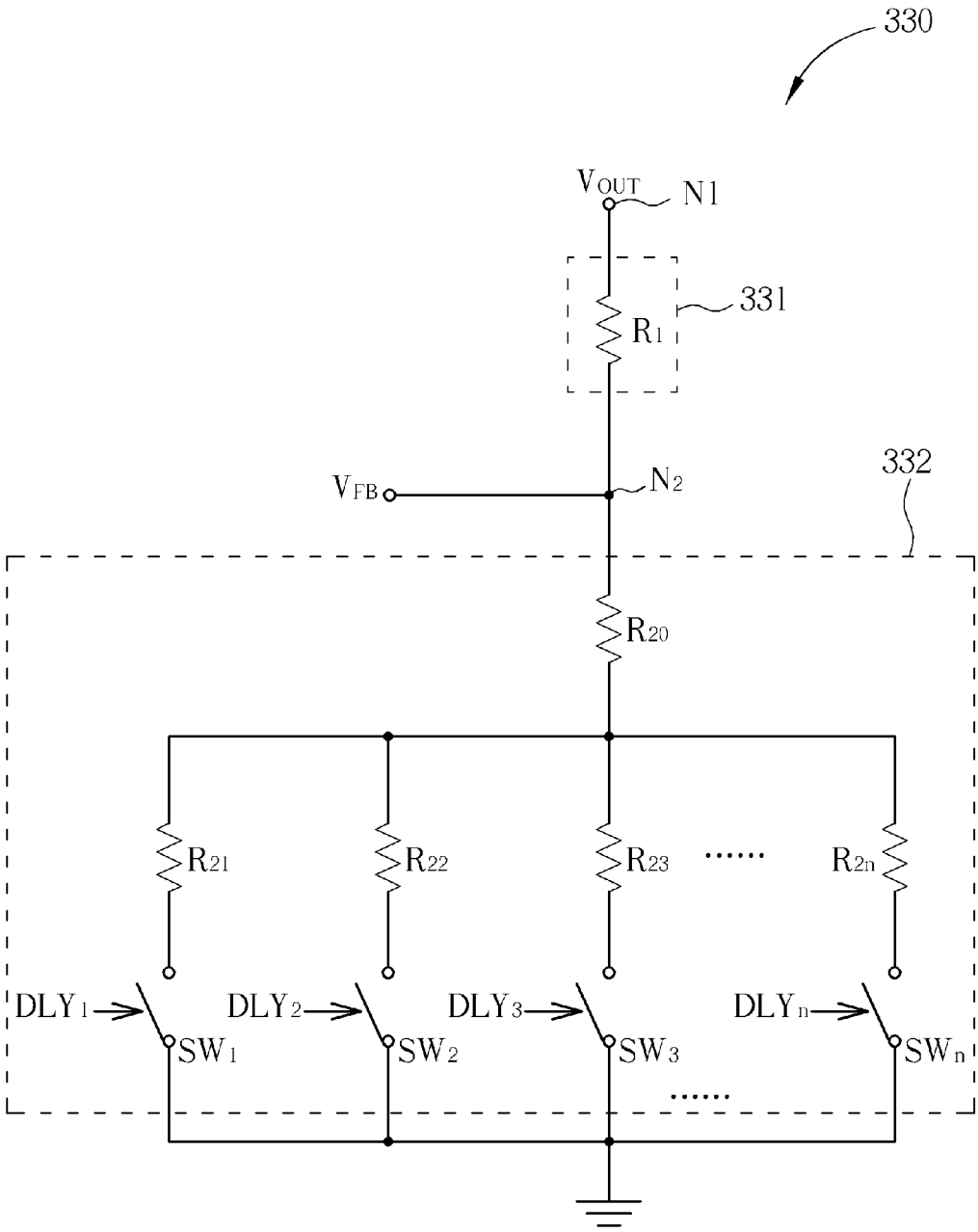
FIG. 4 is a diagram illustrating a voltage-generating circuit according to present invention.

Reference is made to FIG. 4 for a diagram illustrating the voltage-generating circuit 330 according to present invention. In this embodiment, the voltage-generating circuit 330, including two resistor circuits 331 and 332, is configured to receive the output voltage $V_{our}$ at a node N1, voltage-divide the output voltage $V_{OUT}$, and output the corresponding feedback voltage $V_{FB}$ at a node N2. With $R_{EQ1}$ and $R_{EQ2}$ respectively representing the equivalent resistance of the resistor circuits 331 and 332, the relationship between the output voltage $V_{OUT}$ and the reference voltage $V_{REF}$ is depicted as follows:

$$V_{OUT}=(R_1+R_2)*V_{REF}/R_{EQ1}=K*V_{REF},$$

where $K=(R_{EQ1}+R_{EQ2})*R_{EQ1}$

The resistor circuit 331, coupled between the nodes N1 and N2, includes a resistor $R_1$ which determines the equivalent resistance $R_{EQ1}$ of the resistor circuits. The resistor circuit 332, coupled between the node N2 and ground, includes (n+1) resistors $R_{20}$-$R_{2n}$ and n switches $SW_1$-$SW_n$. The switches $SW_1$-$SW_n$ respectively operate according to the delay signals DLY1-DLYn received from the delay signal generator 240. The equivalent resistance $R_{EQ2}$ of the resistor circuit 332 is determined by the resistors $R_{20}$-$R_{2n}$, as well as by the number of turned-on switches in the switches $SW_1$-$SW_n$. For example, if all of the switches $SW_1$-$SW_n$ are turned off (open-circuited), the value of the equivalent resistance $R_{EQ2}$ is infinite; if all of the switches $SW_1$-$SW_n$ are turned on (short-circuited), the value of the equivalent resistance $R_{EQ2}$ is equal to $$R_{20}+\left(\frac{1}{R_{21}}+\frac{1}{R_{22}}+\frac{1}{R_{23}}+\ldots+\frac{1}{R_{2n}}\right)^{-1}.$$

Therefore, the present invention can adjust the predetermined value of the output voltage $V_{our}$ at different time by varying the value of K according to the delay signals DLY1-DLYn, thereby regulating the waveform of the output voltage $V_{OUT}$. In the embodiment depicted in FIG. 4, the resistor circuit 331 provides a constant equivalent resistance $R_{EQ1}$, while the resistor circuit 332 provides an adjustable equivalent resistance $R_{EQ2}$. In another embodiment of the present invention, the resistor circuit 331 may provide an adjustable equivalent resistance $R_{EQ1}$, while the resistor circuit 332 may provide a constant equivalent resistance $R_{EQ2}$. Or, the resistor circuit 331 may provide an adjustable equivalent resistance $R_{EQ1}$, and the resistor circuit 332 may also provide an adjustable equivalent resistance $R_{EQ2}$. The circuit depicted in FIG. 4 is only for illustrative purpose and does not limit the scope of the present invention.

Figure 5:
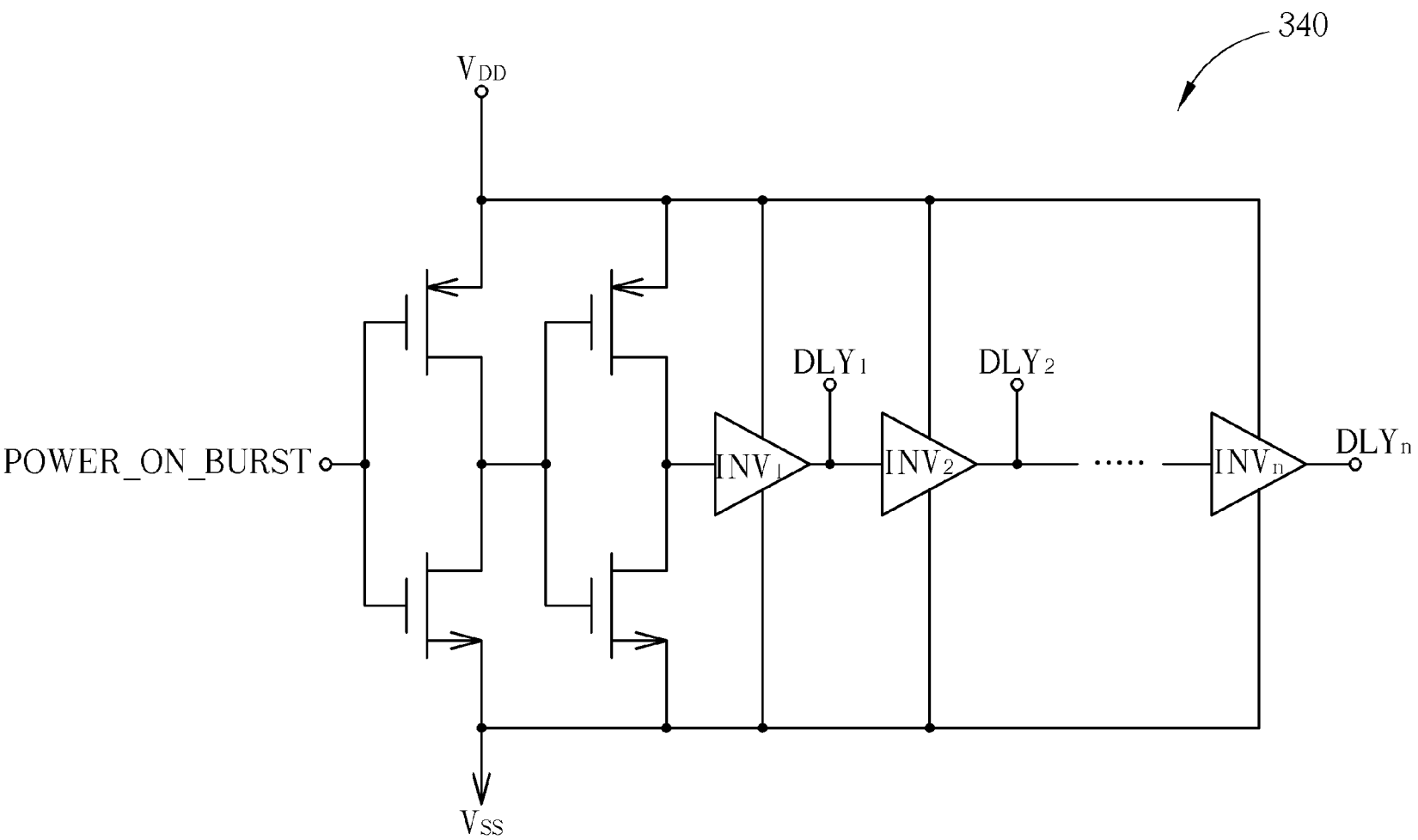
FIG. 5 is a diagram illustrating a delay signal generator according to the present invention.

Reference is made to FIG. 5 for a diagram illustrating the delay signal generator 340 according to the present invention. In this embodiment, the delay signal generator 340 includes n inverters INV1-INVn coupled in series, thereby capable of generating n delay signals DLY1-DLYn each having distinct delay time with respect to the power-on burst signal POWER_ON_BURST. The circuit depicted in FIG. 5 is only for illustrative purpose and does not limit the scope of the present invention.

Figure 6:
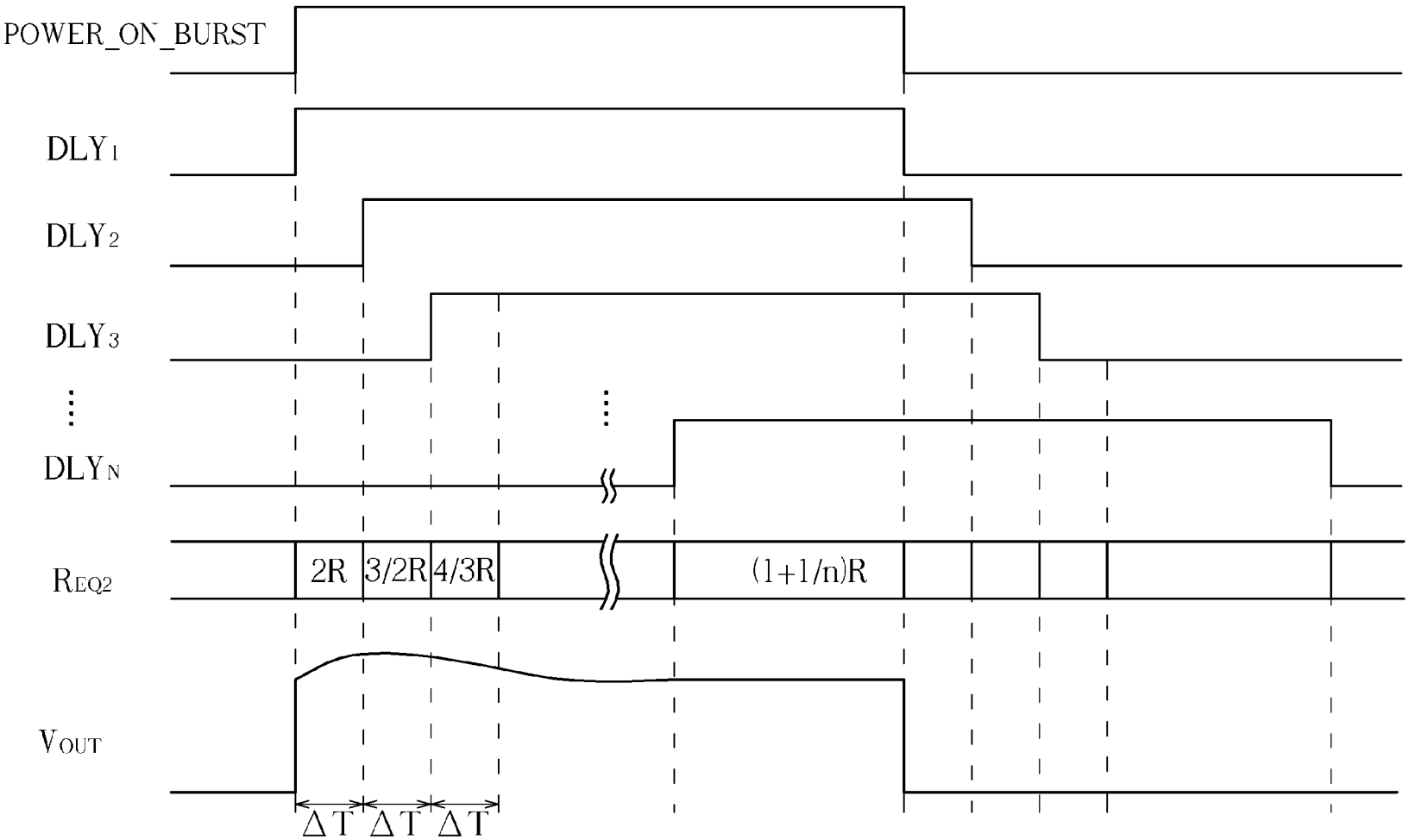
FIG. 6 is a timing diagram illustrating the operation of the LDO regulator in FIG. 3.

Reference is made to FIG. 6 for a timing diagram illustrating the operation of the LDO regulator 30 according to the present invention. FIG. 6 shows the power-on burst signal POWER_ON_BURST, the delay signals DLY1-DLYn, the equivalent resistance $R_{EQ2}$ and the output voltage $V_{OUT}$. For ease of illustration, assume that a constant delay time ΔT exists between two consecutive delay signals among the delay signals DLY1-DLYn, and each resistor in the voltage-generating circuit 330 has an identical resistance R. In the embodiment illustrated in FIG. 6, the delay signals DLY1-

DLYn sequentially turn on the switches $SW_1$-$SW_n$: when the delay signal DLY1 switches from low level to high level, $R_{EQ2}$=2R; when the delay signal DLY2 switches from low level to high level, $R_{EQ2}$=3R/2; when the delay signal DLY3 switches from low level to high level, $R_{EQ2}$=4R/3; . . . ; when the delay signal DLYn switches from low level to high level, $R_{EQ2}$=(1+1/n) R. In other words, the output voltage $V_{OUT}$, having a highest initial value, reaches a stable level as the value of K gradually decreases, thereby capable of regulating the output voltage $V_{OUT}$ with different delay time.

The LDO regulator of the present invention operates according to an externally applied power-on burst signal, and is configured to generate a plurality of delay signals each having distinct delay time with respect to the power-on burst signal. The predetermined value of the output voltage at different time can be adjusted accordingly for providing a stable output voltage or an arbitrarily shaped regulated output voltage.

Those skilled in the art will readily observe that numerous modifications and alterations of the device and method may be made while retaining the teachings of the invention.

What is claimed is:

1. A voltage regulator which provides sequentially and arbitrarily shaped regulated voltage, the voltage regulator comprising:

an amplifier coupled to a reference voltage and a feedback voltage for generating a control signal, the amplifier comprising:

a first input end coupled to the reference voltage;

a second input end coupled to the feedback voltage; and an output end for outputting the control signal;

a power device comprising:

a first input end coupled to an input voltage;

a second input end coupled to the output voltage; and a control end coupled to the control signal;

a delay signal generator coupled to an externally applied power-on burst signal for generating a plurality of sequential delay signals each having distinct delay time with respect to the power-on burst signal; and a voltage-generating circuit coupled to the output voltage and the plurality of sequential delay signals for generating the feedback voltage.

2. The voltage regulator of claim 1 wherein the voltage-generating circuit comprises:

a first node for receiving the output voltage;

a second node for outputting the feedback voltage;

a first resistor circuit coupled between the first node and the second node of the voltage-generating circuit; and a second resistor circuit coupled between the second node of the voltage-generating circuit and a bias voltage for adjusting an equivalent resistance of the voltage-generating circuit according to the plurality of sequential delay signals.

3. The voltage regulator of claim 2 wherein the second resistor circuit comprises:

a first resistor having a first end coupled to the second node of the voltage-generating circuit;

a plurality of second resistors each having a first end coupled to the second end of the first resistor and a second end coupled to the bias voltage; and a plurality of delay switches respectively coupled to corresponding second ends of the plurality of second resistors for controlling signal transmission paths between the corresponding second resistors and the bias voltage according to corresponding delay signals.

4. The voltage regulator of claim 1 wherein the voltage-generating circuit comprises:

a first node for outputting the output voltage;

a second node for receiving the feedback voltage;

a first resistor circuit coupled between the first node and the second node of the voltage-generating circuit for adjusting an equivalent resistance of the voltage-generating circuit according to the plurality of sequential delay signals; and a second resistor circuit coupled between the second node of the voltage-generating circuit and a bias voltage.

5. The voltage regulator of claim 4 wherein the first resistor circuit comprises:

a first resistor having a first end coupled to the first node of the voltage-generating circuit;

a plurality of second resistors each having a first end coupled to the second end of the first resistor; and a plurality of delay switches respectively coupled to corresponding second ends of the plurality of second resistors for controlling signal transmission paths between the corresponding second resistors and the voltage-generating circuit according to corresponding delay signals.

6. The voltage regulator of claim 1 wherein the voltage-generating circuit comprises:

a first node for receiving the output voltage;

a second node for outputting the feedback voltage;

a first resistor circuit coupled between the first node and the second node of the voltage-generating circuit for adjusting an equivalent resistance of the voltage-generating circuit according to the plurality of sequential delay signals; and a second resistor circuit coupled between the second node of the voltage-generating circuit and a bias voltage for adjusting the equivalent resistance of the voltage-generating circuit according to the plurality of sequential delay signals.

7. The voltage regulator of claim 6 wherein:

the first resistor circuit comprises:

a first resistor having a first end coupled to the first node of the voltage-generating circuit;

a plurality of second resistors each having a first end coupled to the second end of the first resistor; and a plurality of first delay switches respectively coupled to corresponding second ends of the plurality of second resistors for controlling signal transmission paths between the corresponding second resistors and the second node of the voltage-generating circuit according to corresponding delay signals; and the second resistor circuit comprises:

a third resistor having a first end coupled to the second node of the voltage-generating circuit;

a plurality of fourth resistors each having a first end coupled to the second end of the third resistor and a second end coupled to the bias voltage; and a plurality of delay switches respectively coupled to corresponding second ends of the plurality of second resistors for controlling signal transmission paths between the corresponding fourth resistors and the bias voltage according to corresponding delay signals.

8. The voltage regulator of claim 1 wherein the delay signal generator comprises a plurality of inverters coupled in series.

9. The voltage regulator of claim 1 wherein the power device is a P-channel metal oxide semiconductor (PMOS) switch.

10. A method for sequentially and arbitrarily regulating an output voltage comprising:

generating a plurality of sequential delay signals according to an externally applied power-on burst signal, wherein each sequential delay signal has a distinct delay time with respect to the power-on burst signal;

adjusting an equivalent resistance according to the plurality of sequential delay signals;

generating a feedback voltage by voltage-dividing the output voltage according to the equivalent resistance; and regulating the output voltage according to the feedback voltage.

11. The method of claim 10 further comprising:

comparing a difference between the feedback voltage and a reference voltage.

12. The method of claim 11 further comprising:

regulating the output voltage according to the difference between the feedback voltage and the reference voltage.

13. The method of claim 10 wherein a constant delay time exists between two consecutive sequential delay signals among the plurality of sequential delay signals.

14. A voltage regulator which sequentially and arbitrarily regulates an output voltage, wherein the voltage regulator generates a plurality of sequential delay signals according to an externally applied power-on burst signal, each sequential delay signal having a distinct delay time with respect to the power-on burst signal, and the voltage regulator regulates the output voltage according to the plurality of sequential delay signals so as to maintain the output voltage at a predetermined level at a specific time.

* * * * *